United States Patent [19]

Degner et al.

[11] 4,235,683

[45] Nov. 25, 1980

[54] ELECTROLYTIC PREPARATION OF BENZALDEHYDES

[75] Inventors: Dieter Degner, Dannstadt-Schauernheim; Hardo Siegel, Speyer, both of Fed. Rep. of Germany

[73] Assignee: BASF Aktiengesellschaft, Fed. Rep. of Germany

[21] Appl. No.: 100,654

[22] Filed: Dec. 5, 1979

[30] Foreign Application Priority Data

Dec. 22, 1978 [DE] Fed. Rep. of Germany ..... 2855508

[51] Int. Cl.[3] ..... C25B 3/00
[52] U.S. Cl. ..... 204/78
[58] Field of Search ..... 204/78

[56] References Cited

PUBLICATIONS

Helv. Chem. Acta. 9 (1926), pp. 1096–1101.

*Primary Examiner*—R. L. Andrews
*Attorney, Agent, or Firm*—Keil & Witherspoon

[57] ABSTRACT

A process for the preparation of benzaldehydes of the general

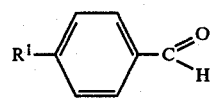

I where $R^1$ is hydrogen or alkyl, wherein a compound of the formula

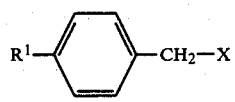

II where X is hydrogen, hydroxyl or $R^2$—COO—, and $R^2$ is hydrogen or alkyl of 1 to 6 carbon atoms, is oxidized electrochemically in the presence of water, of an alkanoic acid of the formula $R^3COOH$ III where $R^3$ is hydrogen or alkyl of 1 to 6 carbon atoms, and of a conductive salt.

6 Claims, No Drawings

ELECTROLYTIC PREPARATION OF BENZALDEHYDES

The present invention relates to a process for the electrochemical preparation of benzaldehydes.

The electrosynthesis of 4-substituted benzaldehydes by anodic oxidation of the corresponding alkylbenzenes is described, for example, in Helv. Chem. Acta 9 (1926), 1097. In this known process, in which the alkylbenzenes are electrolyzed in sulfuric acid solution, the benzaldehydes are obtained in only low yield. Furthermore, the isolation of the aldehydes from the multi-component mixture formed during electrolysis presents such great difficulties that this method of synthesis has not proved feasible in industrial operation.

We have found that a benzaldehyde of the general formula

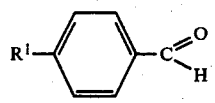

I where $R^1$ is hydrogen or alkyl of 1 to 4 carbon atoms is obtained in high yield and with high current efficiency if a compound of the formula

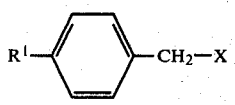

II where X is hydrogen, hydroxyl or $R^2$—COO—, and $R^2$ is hydrogen or alkyl of 1 to 6 carbon atoms, is electrochemically oxidized in the presence of water, of an alkanoic acid of the formula $$R^3COOH \qquad \text{III}$$

where $R^3$ is hydrogen or alkyl of 1 to 6 carbon atoms, and of a fluoride, tetrafluoborate, perchlorate or sulfate as a conductive salt.

Suitable alkyl radicals $R^2$ and $R^3$ are those of 1 to 6, preferably of 1 to 4, carbon atoms. Accordingly, starting materials of the formula II are methylbenzenes, benzyl alcohols or the alkanoic acid esters of the benzyl alcohols, the said alcohols being either unsubstituted in the 4-position or containing the said radical $R^1$ in the 4-position; examples of the starting materials are thus toluene, p-xylene, p-tert.-butyltoluene, benzyl alcohol, p-methylbenzyl alcohol, p-tert.-butylbenzyl alcohol, benzyl acetate, p-methylbenzyl acetate and p-tert.-butylbenzyl acetate. Amongst these starting materials, p-xylene, p-tert.-butyltoluene, p-methylbenzyl alcohol, p-tert.-butylbenzyl alcohol, p-methylbenzyl acetate and p-tert.-butylbenzyl acetate are industrially of particular interest.

Preferred alkanoic acids of the formula III are formic acid, acetic acid and propionic acid.

The electrolyte used is a mixture of the benzene derivative of the formula II, water, the alkanoic acid of the formula III and the conductive salt. The conductive salts are fluorides, eg. NaF and KF, tetrafluoborates, eg. $NaBF_4$ and $Et_4NBF_4$, perchlorates, eg. $NaClO_4$ and $Et_4NClO_4$, and sulfates, eg. $Et_4NSO_4Et$. The tetrafluoborates are preferred. The composition of the electrolytes can be selected within wide limits. The solutions employed for the electrolysis have, for example, the following composition:

From 5 to 50% by weight of starting compound II
From 3 to 25% by weight of $H_2O$
From 45 to 90% by weight of alkanoic acid III
From 0.5 to 10% by weight of conductive salt Electrode materials selected for the process according to the invention are those which are stable under the electrolysis conditions. Examples of suitable anode materials are graphite, noble metals, eg. platinum, and titanium electrodes coated with a noble metal. Examples of suitable cathodes are graphite, iron, steel, lead and noble metal electrodes. The current density and conversion can also be selected within wide limits. For example, the current density is from 1 to 10 A/dm$^2$. The electrolysis itself is carried out with, for example, from 2 to 12, preferably from 4 to 12, F/mole of starting compound, at below 100° C., advantageously at from 10° to 90° C. The process according to the invention may be carried out in compartmented or non-compartmented electrolysis cells.

The material discharged from the electrolysis is as a rule worked up by distillation. The alkanoic acid, water and any starting materials which may still be present are separated from the benzaldehydes by distillation and can be recycled to the electrolysis. The conductive salts can then be separated from the aldehydes, for example by filtration, and can also be reemployed in the electrolysis. The benzaldehydes can be purified further, for example by rectification. The carboxylic acid esters of the corresponding benzyl alcohols, which are formed as by-products in the process according to the invention, can be recycled to the electrolysis. However, they can also be isolated before being recycled and be hydrolyzed to the corresponding benzyl alcohols by conventional methods, for example by acid trans-esterification with $CH_3OH/H_2SO_4$.

The benzaldehydes obtainable by the process according to the invention are valuable intermediates for active compounds and scents. For example, 4-tert.-butylbenzaldehyde is used as a fungicide intermediate, and also as a starting material for the scent lilial.

The Examples which follow further illustrate the process according to the invention.

EXAMPLE 1

Anodic oxidation of p-tert.-butyltoluene

Apparatus: non-compartmented cell with 7 electrodes
Anodes: graphite
Electrolyte:
296 g of p-tert.-butyltoluene
2,700 g of acetic acid
300 g of water
60 g of $NaBF_4$
Cathodes: graphite
Temperature: 55°–70° C.
Current density: 2.8 A/dm$^2$ The electrolysis is carried out with 4 F/mole of p-tert.-butyltoluene. During the electrolysis, the electrolyte is circulated through a heat exchanger.

Working-up

After completion of the electrolysis, the acetic acid and water are distilled off under atmospheric pressure, the $NaBF_4$ (57 g) is filtered off and the residue is subjected to fractional distillation at from 20 to 2 mm Hg and from 30° to 100° C. This gives 6.2 g of unconverted p-tert.-butyltoluene, 133.5 g of p-tert.-butylbenzaldehyde and 141.1 g of p-tert.-butylbenzyl acetate. This corresponds to a yield of 77% and a current efficiency of 58.4%. To isolate the p-tert.-butylbenzaldehyde, the mixture is rectified at from 20 to 30 mm Hg, with a bottom temperature of from 150° to 170° C. The p-tert.-butylbenzyl acetate obtained as the bottom product can be recycled to the electrolysis.

EXAMPLE 2

The procedure described in Example 1 is followed, but the electrolysis of p-tert.-butyltoluene is carried out with 6.5 F/mole. In this case, 198 g of p-tert.-butylbenzaldehyde (corresponding to a yield of 66.5%) are obtained in addition to 22 g of p-tert.-butylbenzyl acetate.

EXAMPLE 3

Anodic oxidation of p-tert.-butyltoluene
- Apparatus: non-compartmented cell with 7 electrodes
- Anodes: graphite
- Electrolyte:
  - 296 g of p-tert.-butyltoluene
  - 2,550 g of acetic acid
  - 450 g of water
  - 60 g of $NaBF_4$
- Cathodes: graphite
- Temperature: 57°–60° C.
- Current density: 2.8 A/dm$^2$ The electrolysis is carried out with 4.25 F/mole of p-tert.-butyltoluene. During the electrolysis, the electrolyte is circulated through a heat exchanger.

Working-up

If the material discharged from the electrolysis is worked up similarly to Example 1, 120.3 g of p-tert.-butylbenzaldehyde and 144.1 g of p-tert.-butylbenzyl acetate are obtained in addition to 13.2 g of unconverted p-tert.-butyltoluene. This corresponds to a yield of 75.5% and a current efficiency of 51.4%.

EXAMPLE 4

Anodic oxidation of p-tert.-butyltoluene
- Apparatus: non-compartmented cell with 7 electrodes
- Anodes: graphite
- Electrolyte:
  - 592 g of p-tert.-butyltoluene
  - 2,550 g of acetic acid
  - 450 g of water
  - 60 g of $NaBF_4$
- Cathodes: graphite
- Temperature: 52°–61° C.
- Current density: 5.5 A/dm$^2$ The electrolysis is carried out with 4.25 F/mole of p-tert.-butyltoluene. During the electrolysis, the electrolyte is circulated through a heat exchanger.

Working-up

If the material discharged from the electrolysis is worked up similarly to Example 1, 284.8 g of p-tert.-butylbenzaldehyde and 295.3 g of p-tert.-butylbenzyl acetate are obtained in addition to 25.2 g of unconverted p-tert.-butyltoluene. This corresponds to a yield of 83.3% and a current efficiency of 58.2%. The p-tert.-butylbenzaldehyde is separated from the p-tert.-butylbenzyl acetate by the method described in Example 1.

90 g of the p-tert.-butylbenzyl acetate isolated as a by-product are mixed with 96 g of methanol and 1 g of concentrated sulfuric acid and the mixture is refluxed for three hours whilst stirring. After cooling, the solution is neutralized with NaOH. Methanol and methyl acetate are distilled off under atmospheric pressure and the residue is subjected to fractional distillation at 0.1 mm Hg and 68°–70° C. This gives 65 g of p-tert.-butylbenzyl alcohol (corresponding to a yield of 90.7%), and this alcohol can be employed for the preparation of p-tert.-butylbenzaldehyde, for example in accordance with Example 5.

EXAMPLE 5

Anodic oxidation of p-tert.-butylbenzyl alcohol
- Apparatus: non-compartmented cell with 7 electrodes
- Anodes: graphite
- Electrolysis:
  - 290 g of p-tert.-butylbenzyl alcohol
  - 2,550 g of acetic acid
  - 450 g of water
  - 60 g of $NaBF_4$
- Cathodes: graphite
- Temperature: 49°–60° C.
- Current density: 5.5 A/dm$^2$ The electrolysis is carried out with 2 F/mole of p-tert.-butylbenzyl alcohol. During the electrolysis, the electrolyte is circulated through a heat exchanger.

Working-up

After completion of the electrolysis, the acetic acid and water are distilled off under atmospheric pressure, the $NaBF_4$ (55 g) is filtered off and the residue is subjected to fractional distillation at from 2 to 3 mm Hg and from 77° to 100° C. This gives 4.9 g of p-tert.-butylbenzyl alcohol, 166.9 g of p-tert.-butylbenzaldehyde and 70.4 g of p-tert.-butylbenzyl acetate. This corresponds to a yield of 73.7% and a current efficiency of 58.3%.

EXAMPLE 6

Anodic oxidation of p-tert.-butylbenzyl acetate
- Apparatus: non-compartmented cell with 7 electrodes
- Anodes: graphite
- Electrolyte:
  - 309 g of p-tert.-butylbenzyl acetate
  - 2,550 g of acetic acid
  - 450 g of water
  - 60 g of $NaBF_4$
- Cathodes: graphite
- Temperature: 58°–61° C.
- Current density: 5.4 A/dm$^2$ The electrolysis is carried out with 2 F/mole of p-tert.-butylbenzyl acetate. During the electrolysis, the electrolyte is circulated through a heat exchanger.

Working-up

After completion of the electrolysis, the acetic acid and water are distilled off under atmospheric pressure, the $NaBF_4$ (55 g) is filtered off and the residue is subjected to fractional distillation at from 1 to 5 mm Hg and from 35° to 110° C. This gives 139.6 g of unconverted p-tert.-butylbenzyl acetate and 105.7 g of p-tert.-butylbenzaldehyde, corresponding to a yield of 79.4% and a current efficiency of 43.5%.

EXAMPLE 7

Anodic oxidation of p-xylene
- Apparatus: non-compartmented cell with 7 electrodes
- Anodes: graphite
- Electrolyte:
  - 196 g of p-xylene
  - 2,550 g of acetic acid
  - 450 g of water
  - 60 g of $NaBF_4$
- Cathodes: graphite
- Temperature: 58°–63° C.
- Current density: 5.5 A/dm$^2$ The electrolysis is carried out with 5.8 F/mole of p-xylene. During the electrolysis, the electrolyte is circulated through a heat exchanger.

Working-up

After completion of the electrolysis, the acetic acid, water and unconverted p-xylene (24.8 g) are distilled off under atmospheric pressure, $NaBF_4$ (54 g) is filtered off and the residue is subjected to fractional distillation at from 30° to 110° C. and from 0.7 to 2 mm Hg. This gives 70.4 g of p-methylbenzaldehyde and 70.3 g of p-methylbenzyl acetate, corresponding to a yield of 62.9%.

EXAMPLE 8

Anodic oxidation of p-xylene
- Apparatus: non-compartmented cell with 5 electrodes
- Anodes: platinum
- Electrolyte:
  - 212 g of p-xylene
  - 3,060 g of acetic acid
  - 540 g of water
  - 60 g of $NaBF_4$
- Cathodes: platinum
- Temperature: 59°–61° C.
- Current density: 6.3 A/dm$^2$ The electrolysis is carried out with 4 F/mole of p-xylene. During the electrolysis, the electrolyte is circulated through a heat exchanger.

Working-up

If the material discharged from the electrolysis is worked up similarly to Example 7, 136.2 g of unconverted p-xylene, 30 g of methylbenzaldehyde and 40.3 g of p-methylbenzyl acetate are obtained. This corresponds to a yield of 69.4%.

EXAMPLE 9

Anodic oxidation of toluene
- Apparatus: non-compartmented cell with 5 electrodes
- Anodes: graphite
- Electrolyte:
  - 184 g of toluene
  - 3,060 g of acetic acid
  - 540 g of water
  - 60 g of $NaBF_4$
- Cathodes: graphite
- Temperature: 55°–62° C.
- Current density: 5.4 A/dm$^2$ The electrolysis is carried out with 5.25 F/mole of toluene. During the electrolysis, the electrolyte is circulated through a heat exchanger.

Working-up

After completion of the electrolysis, the water, acetic acid and unconverted toluene (43 g) are distilled off under atmospheric pressure, $NaBF_4$ (58 g) is filtered off and the residue is subjected to fractional distillation at from 10 to 30 mm Hg and from 30° to 100° C. This gives 81.6 g of benzaldehyde and 31.9 g of benzyl acetate, corresponding to a yield of 64.6%.

We claim:

1. A process for the preparation of a benzaldehyde of the general formula

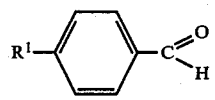

I where $R^1$ is hydrogen or alkyl of 1 to 4 carbon atoms, wherein a compound of the formula

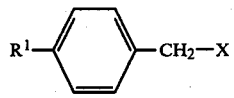

II where X is hydrogen, hydroxyl or $R^2$—COO—, and $R^2$ is hydrogen or alkyl of 1 to 6 carbon atoms, is oxidized electrochemically in the presence of water, of an alkanoic acid of the formula $R^3COOH$ III where $R^3$ is hydrogen or alkyl of 1 to 6 carbon atoms, and of a fluoride, tetrafluoborate, perchlorate or sulfate as a conductive salt.

2. A process as claimed in claim 1, wherein toluene, p-xylene or p-tert.-butyltoluene is used as the starting compound of the formula II.

3. A process as claimed in claim 1, wherein a tetrafluoborate is used as the conductive salt.

4. A process as claimed in claim 1, wherein formic acid, acetic acid or propionic acid is used as the alkanoic acid of the formula III.

5. A process as claimed in claim 1, wherein the electrolysis is carried out at a current density of from 1 to 10 A/dm$^2$, and at below 100° C.

6. A process as claimed in claim 1, wherein the electrolysis is carried out with from 2 to 12 F per mole of compound of the formula II.

* * * * *